US008481835B1

(12) United States Patent
Liao

(10) Patent No.: US 8,481,835 B1
(45) Date of Patent: Jul. 9, 2013

(54) FOOT PEDAL FOLDING STRUCTURE

(76) Inventor: Tsun-Chi Liao, Taichung (TW)

( * ) Notice: Subject to any disclaimer, the term of this patent is extended or adjusted under 35 U.S.C. 154(b) by 0 days.

(21) Appl. No.: 13/480,730

(22) Filed: May 25, 2012

(51) Int. Cl.
*G10D 13/02* (2006.01)

(52) U.S. Cl.
USPC ..... 84/422.3

(58) Field of Classification Search
USPC ..... 84/422.1, 422.2, 422.3
See application file for complete search history.

(56) References Cited

U.S. PATENT DOCUMENTS 4,381,690 A * 5/1983 Kimble ..... 84/422.3

* cited by examiner

*Primary Examiner* — Kimberly Lockett
(74) *Attorney, Agent, or Firm* — Muncy, Geissler, Olds & Lowe, PLLC

(57) ABSTRACT

A foot pedal folding structure to allow a foot pedal swiveling against a stand of a musical instrument for folding includes a pedal rack, a rack sleeve and a swivel shaft. The swivel shaft includes a circular pin, a first non-circular pin and a second non-circular pin. The pedal rack has a first boss and a second boss which respectively include a first holding aperture and a second holding aperture. The rack sleeve has a rotary boss located between the first boss and second boss. The rotary boss has a rotary hole. The swivel shaft has a latch position in which the second non-circular pin straddles the second holding aperture and rotary hole, and a swivel position in which the swivel shaft fully passes through the rotary hole.

9 Claims, 9 Drawing Sheets

FOOT PEDAL FOLDING STRUCTURE

FIELD OF THE INVENTION

The present invention relates to a foot pedal of musical instruments and particularly to a foot pedal folding structure for musical instruments.

BACKGROUND OF THE INVENTION

A conventional stand 2 for musical instruments, referring to FIGS. 1 and 2, aims to hold a musical instrument 1 and is coupled with a foot pedal 3 to enable a user to step the foot pedal 3 to strike the musical instrument to generate sound.

When the musical instrument 1 is not in use, in order to facilitate storage the foot pedal 3 is folded in parallel with the stand 2 to reduce storage space. To make the foot pedal 3 foldable, the foot pedal 3 is hinged on the stand 2 through a swivel structure 4 and fastened via a fastening element 5. To fold and swivel the conventional foot pedal 3, a screw 6 on the fastening element 5 have to be unfastened first to loosed the fastening element 5; then the foot pedal 3 can be swiveled and folded; thereafter, the screw 6 is fastened again to make the fastening element 5 tightly fastened to the swivel structure 4 to keep the foot pedal 3 in parallel with the stand 2.

The aforesaid conventional structure relies on fastening the screw to make secure tightening and holding. The operation is tedious and time consuming. Moreover, tightening via merely compression of the fastening element 5 results in concentration of forces in a small area, which could cause loosening off or even fractures and damages after a prolonged period of time, thus cannot fully meet use requirements.

SUMMARY OF THE INVENTION

Therefore the primary object of the present invention is to provide a foot pedal folding structure that is operable simply and structured sturdily.

To achieve the foregoing object the foot pedal folding structure according to the invention allows a foot pedal to swivel against a stand of a musical instrument. The folding structure includes a swivel shaft, a pedal rack and a rack sleeve. The swivel shaft includes a circular pin, a first non-circular pin and a second non-circular pin. The circular pin is formed at a diameter no greater than the smallest diameter of the first and second non-circular pins. The circular pin is located between the first and second non-circular pins. The foot pedal is installed on the pedal rack which has a first boss and a second boss. The first boss and second boss have respectively a first holding aperture and a second holding aperture formed thereon to allow the first and second non-circular pins to pass through and be latched therein without turning. The rack sleeve holds the stand of the musical instrument. The rack sleeve includes a rotary boss located between the first boss and second boss. The rotary boss is formed at a thickness no greater than the length of the pin, and has a rotary hole to allow the circular pin to swivel therein and latch the second non-circular pin from turning. The swivel shaft can slide through the first holding aperture, second holding aperture and rotary hole, and has a latch position in which the second non-circular pin straddles the second holding aperture and rotary hole, and a swivel position in which the circular pin fully passes through the rotary hole.

By means of the construction set forth above, the rotary shaft can be switched between the latch position and swivel position to control swivel of the foot pedal against the stand of the musical instrument. The structure thus formed is operable simply and quickly. By forming latch through the shapes of the non-circular pin and second holding aperture the force bearing area is greater and structural strength is enhanced, thus can meet use requirements.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
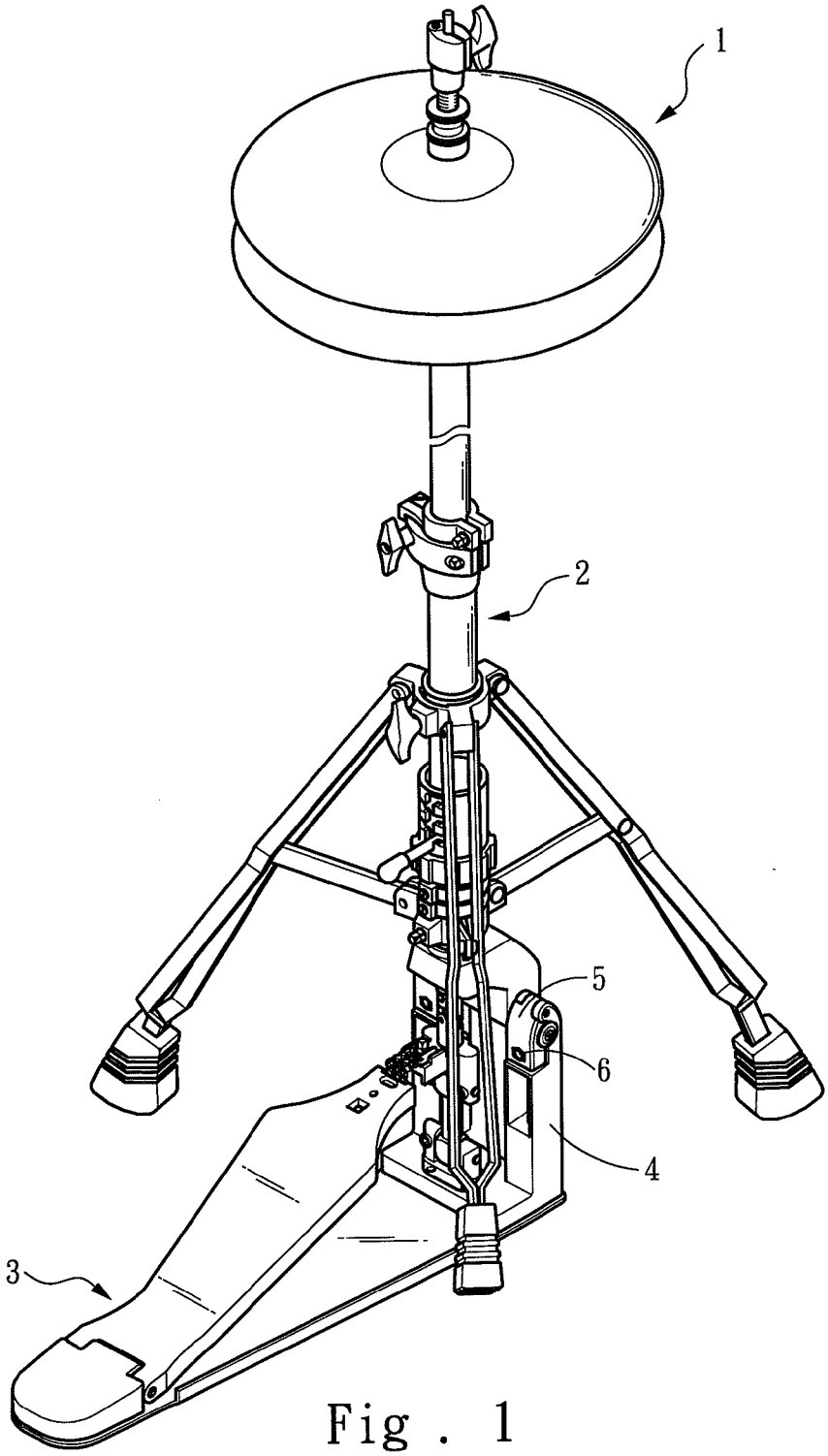
Fig. 1 PRIOR ART
FIG. 1 is a schematic view of a conventional foot pedal of musical instruments.
Figure 2:
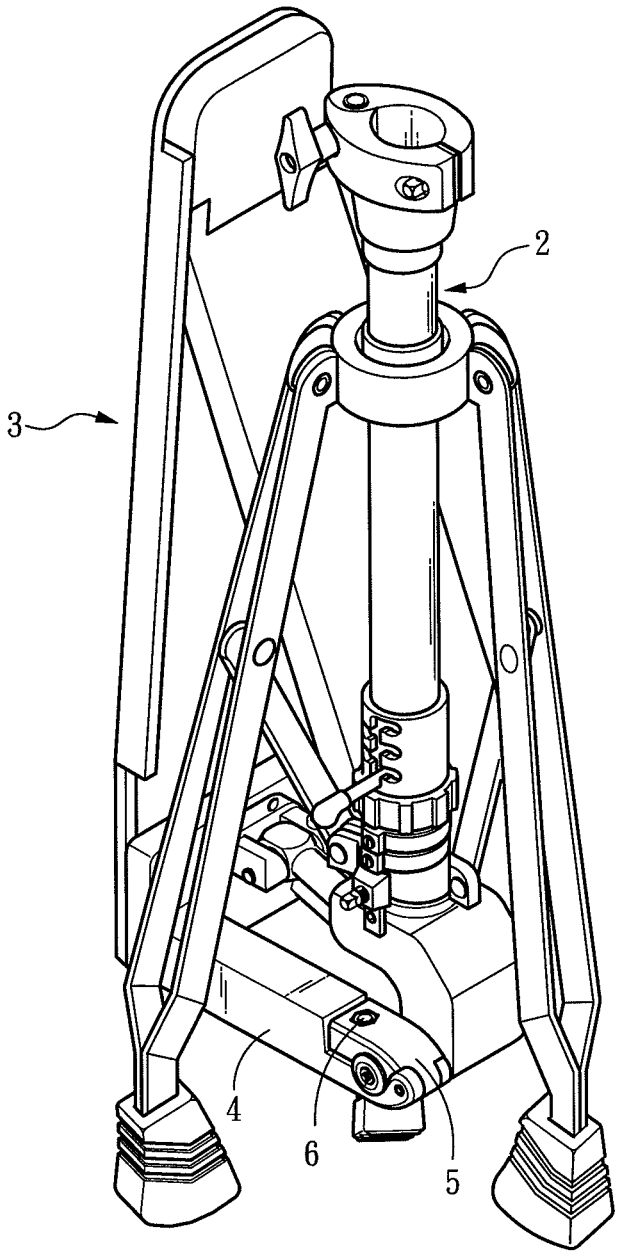
Fig . 2 PRIOR ART
FIG. 2 is a schematic view of a conventional foot pedal of musical instruments in a folding condition.
Figure 3:
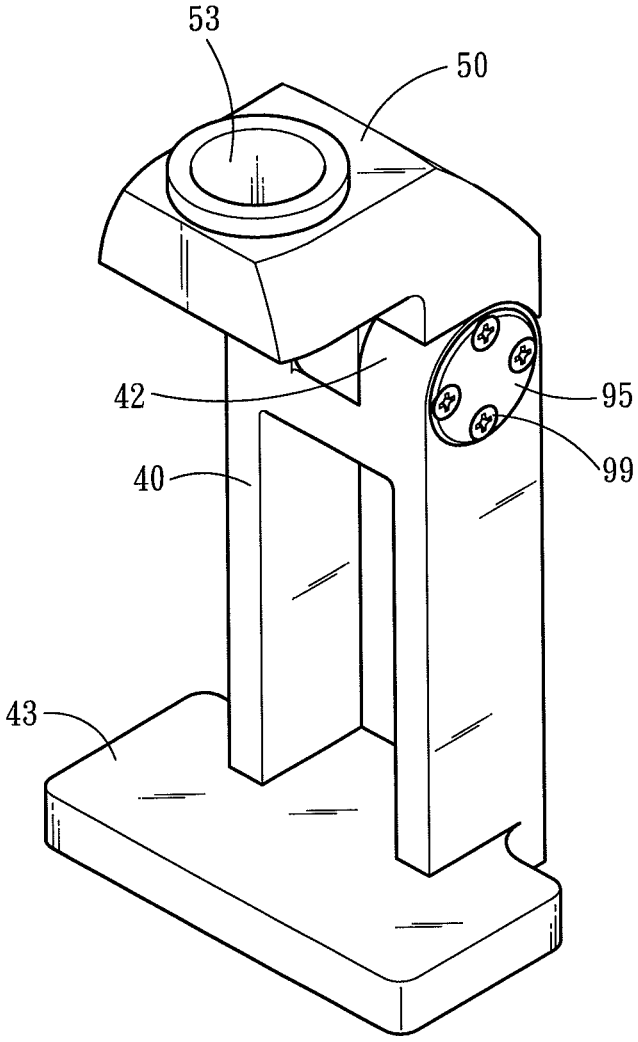
FIG. 3 is a perspective view of the invention.
Figure 4:
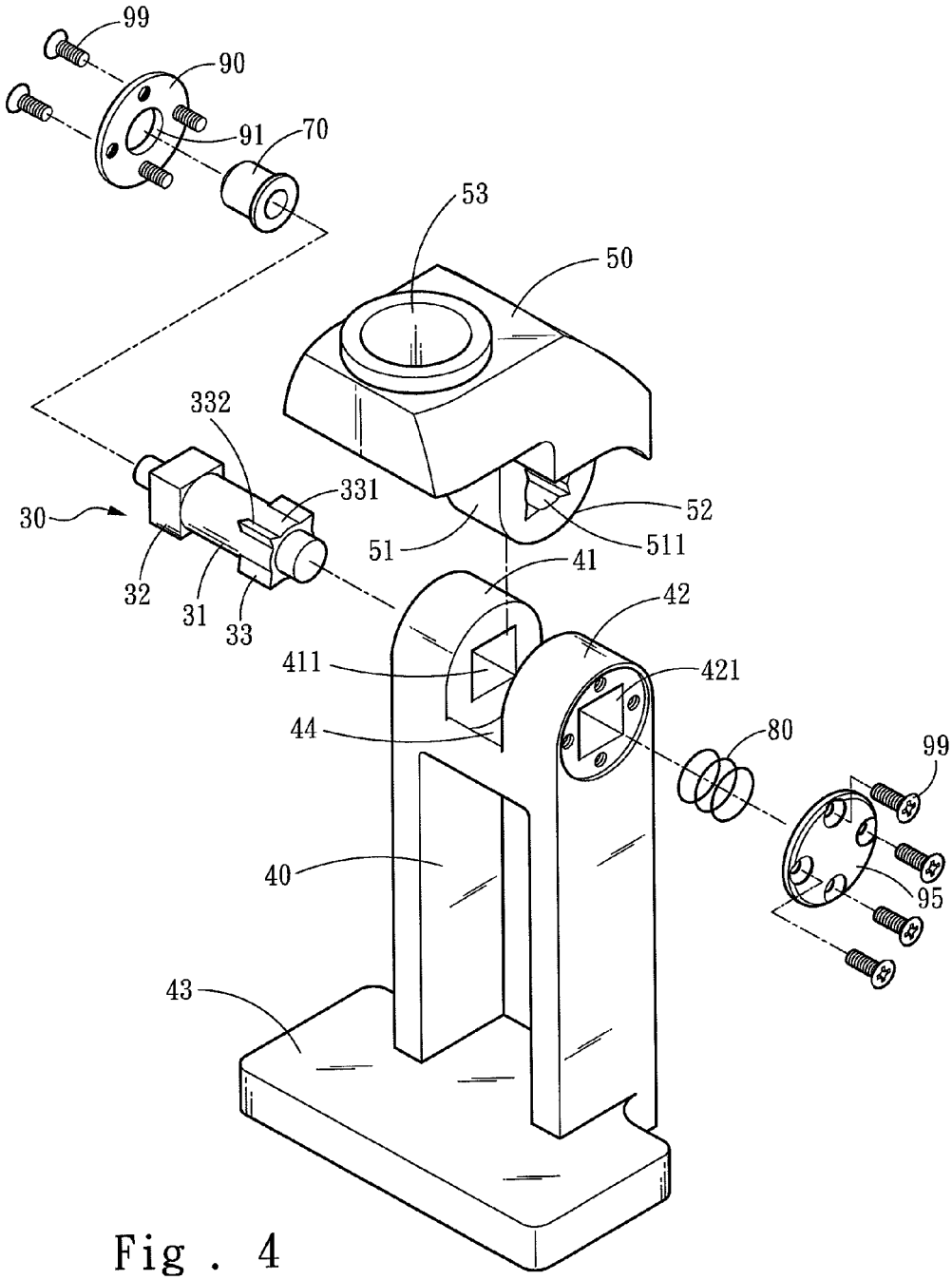
FIG. 4 is an exploded view of the invention.

Please referring to FIGS. 3, 4 5A and 5B, the present invention aims to provide a foot pedal folding structure for musical instruments. It comprises a swivel shaft 30, a pedal rack 40 and a rack sleeve 50. The swivel shaft 30 has a circular pin 31, a first non-circular pin 32 and a second non-circular pin 33. The circular pin 31 is formed at a diameter no greater than the smallest diameter of the first and second non-circular pins 32 and 33, preferably equal to the smallest diameter of the non-circular pin 32 or 33. The circular pin 31 is located between the first and second non-circular pins 32 and 33.

The pedal rack 40 has a first boss 41 and a second boss 42. The first boss 41 and second boss 42 have respectively a first holding aperture 411 and a second holding aperture 421 to allow the first and second non-circular pins 32 and 33 to pass through and be latched therein without turning. The first non-circular pin 32 and first holding aperture 411 can be formed in a square shape mating each other. The second non-circular pin 33 can include a circular contact surface 331 and at least one boss 332 formed on the circular contact surface 331 to latch on the second holding aperture 421.

The rack sleeve 50 includes a rotary boss 51 located between the first boss 41 and second boss 42. The rotary boss is formed at a thickness no greater than the length of the circular pin 31, and has a rotary hole 511 to allow the circular pin 31 to swivel therein and latch the second non-circular pin 33 from turning. The second non-circular pin 33 is formed in a shape mating the rotary hole 511. The pedal rack 40 and rack sleeve 50 have respectively an arched surface 44 and 52 swiveling against each other and in contact with each other, thereby provide greater contact to increase swivel stability.

The swivel shaft 30 passes through the first holding aperture 411, second holding aperture 421 and rotary hole 511 is a slidable manner, and forms a latch position (referring to FIG. 5A) with the second non-circular pin 33 straddling the second holding aperture 421 and rotary hole 511, and a swivel position (referring to FIG. 5B) with the circular pin 31 fully passing through the rotary hole 511.

In addition, the invention further includes a pushbutton 70, a compression spring 80, a first fastening retaining plate 90 and a second fastening retaining plate 95. The first and second fastening retaining plates 90 and 95 are fastened to two sides of the pedal rack 40 via at least one screw 99. The first fastening retaining plate 90 has an opening 91. The pushbutton 70 is fastened to one end of the swivel shaft 30 and runs through the opening 91 to be retained by the first fastening retaining plate 90. The compression spring 80 is located between the second fastening retaining plate 95 and swivel shaft 30 to push the swivel shaft 30 at the latch position. Push the pushbutton 70 to compress the compression spring 80 the swivel shaft 30 is moved to the swivel position.

Figure 5A:
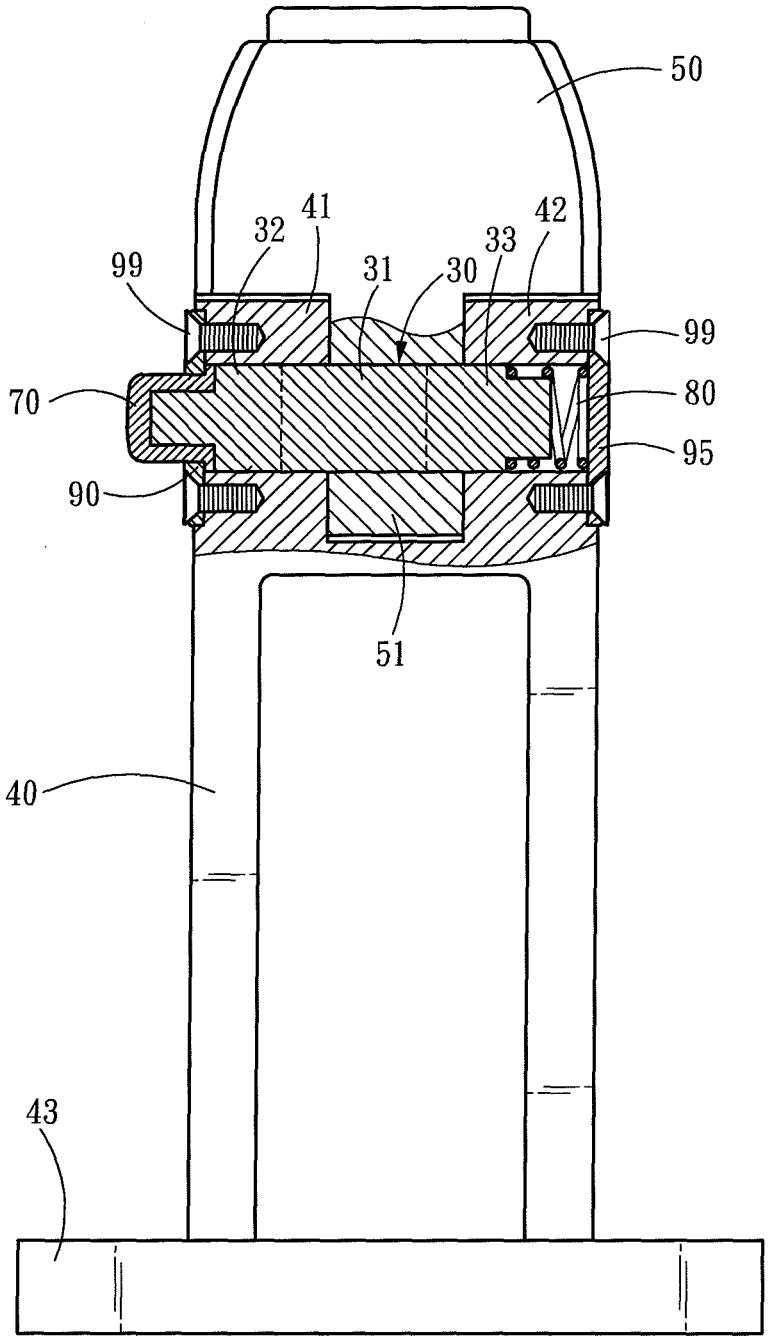
FIG. 5A is a sectional view of the invention.
Figure 5B:
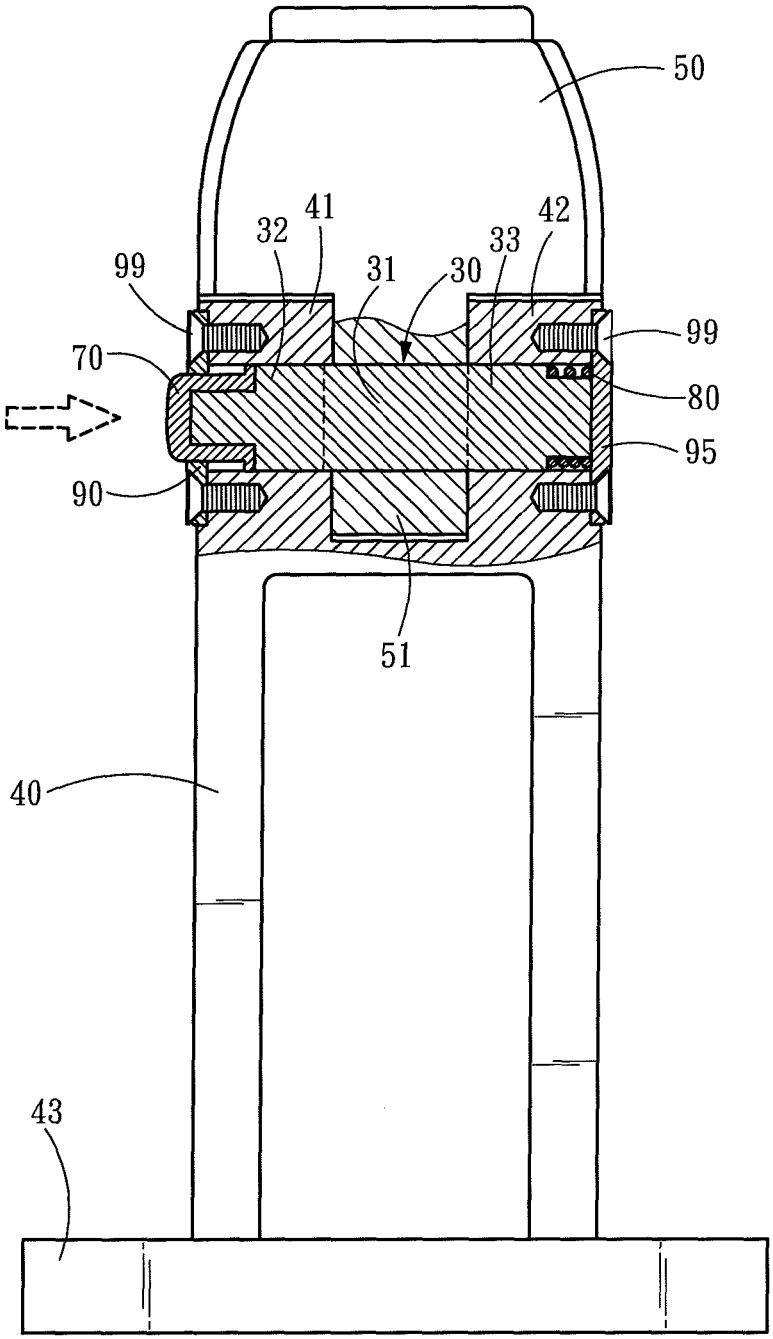
FIG. 5B is a sectional view of the invention before folding.
Figure 6:
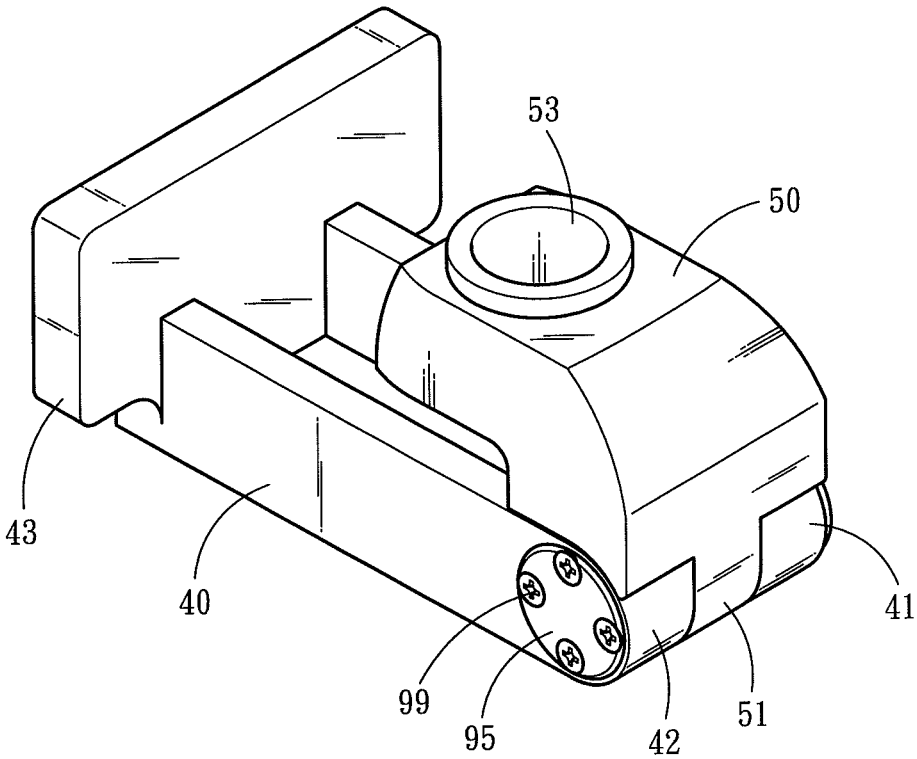
FIG. 6 is a schematic view of the invention in a folding condition.

Also referring to FIG. 6, when the pushbutton 70 is pushed to compress the compression spring 80 the swivel shaft 30 is moved to the swivel position (as shown in FIG. 5B), the pedal rack 40 can be swiveled against the rack sleeve 60 (referring to FIG. 6); release the compression spring 80, its returning force pushes the swivel shaft 30 back to the latch position to latch the pedal rack 40 and rack sleeve 50 without swiveling.

Figure 7:
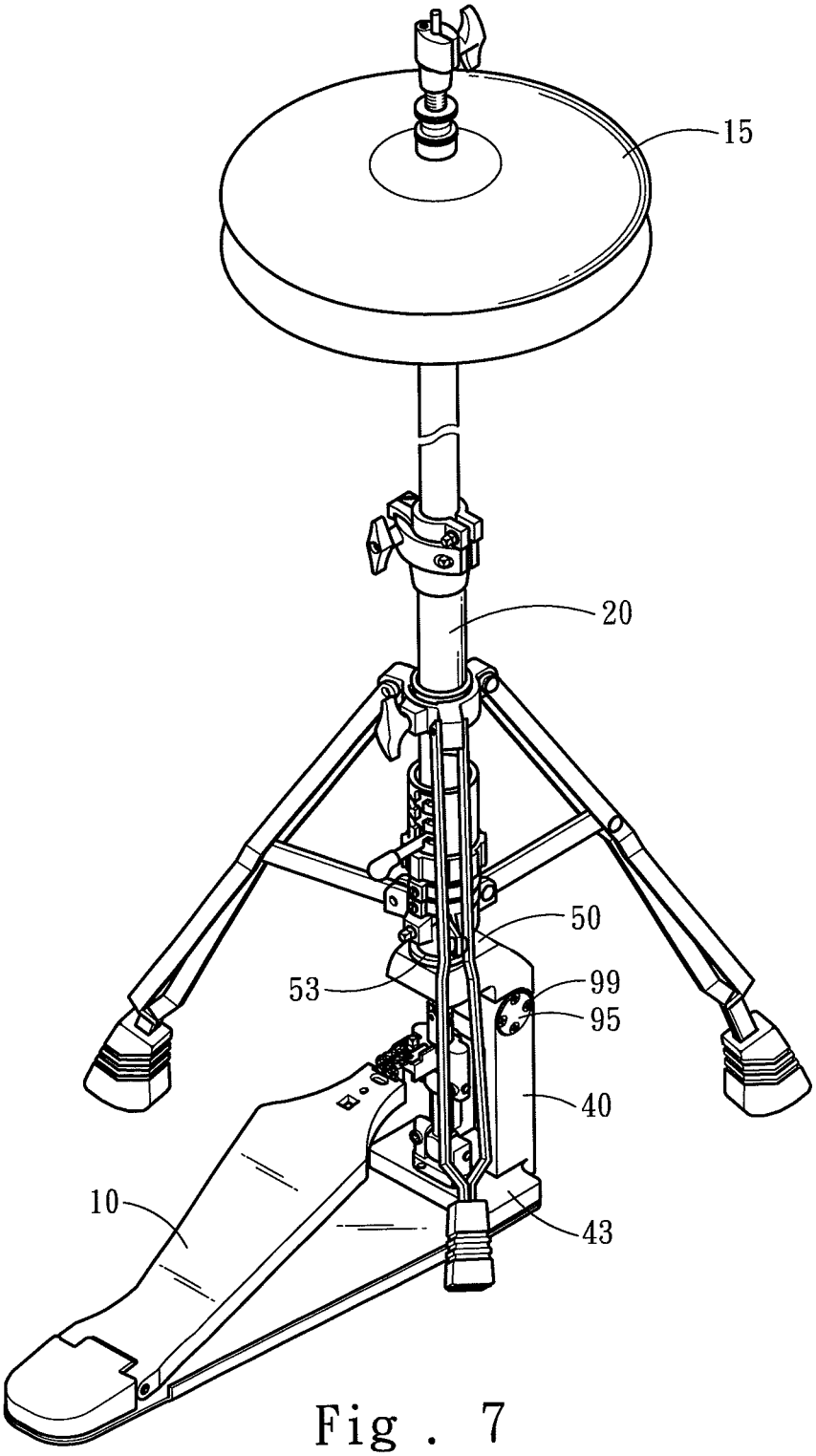
FIG. 7 is a schematic view of an embodiment of the invention.
Figure 8:
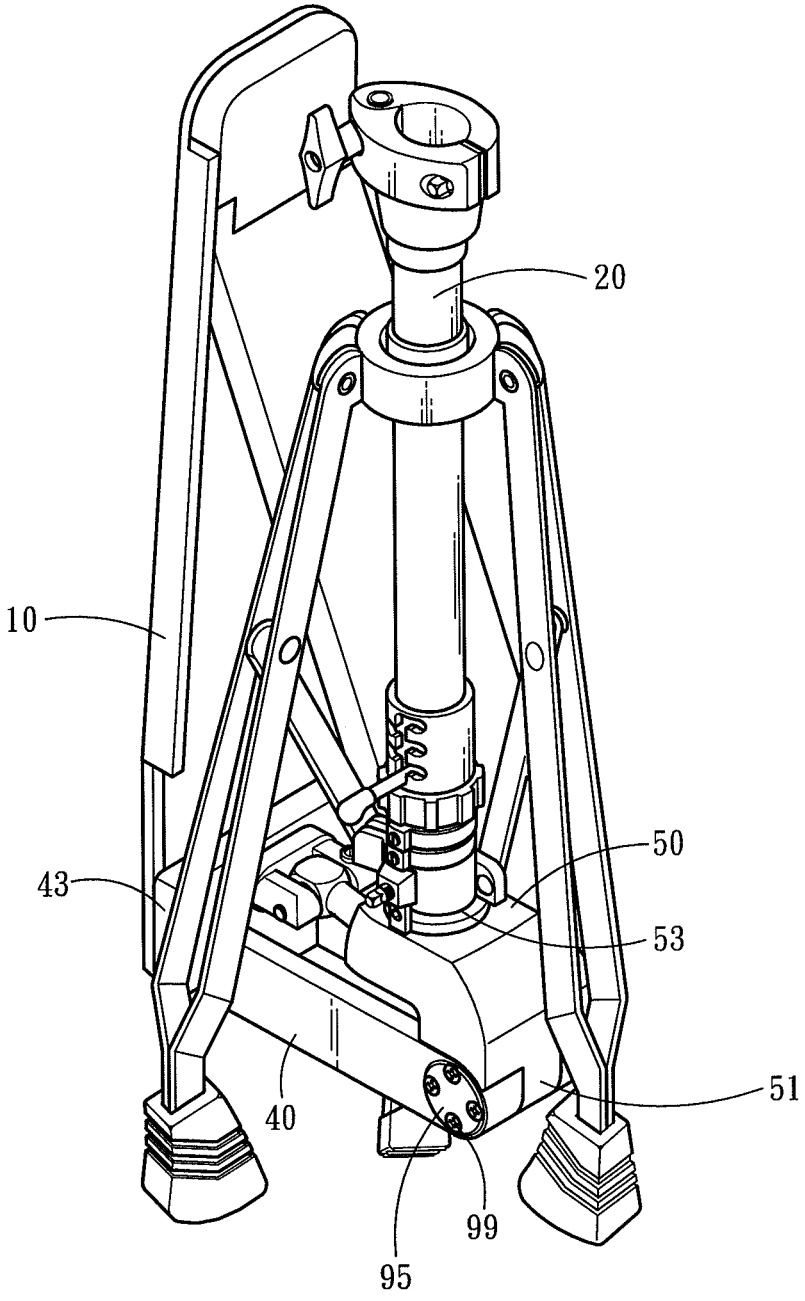
FIG. 8 is a schematic view of an embodiment of the invention in a folding condition.

Please referring to FIGS. 7 and 8, the invention allows a foot pedal 10 to swivel against a stand 20 of a musical instrument 15. The musical instrument 15 is held on the stand 20. The foot pedal 10 is installed on the pedal rack 40. The stand 20 is held on the rack sleeve 50. The pedal rack 40 has a base plate 43 to hold the foot pedal 10. The stand 20 can run through an orifice 53 of the rack sleeve 50 to be held therein. Thus the pedal rack 40 can swivel against the rack sleeve 50 to swivel the foot pedal 10 against the stand 20, i.e., the foot pedal 10 can be moved in parallel with the stand 20 (as shown in FIG. 8).

As a conclusion, the swivel shaft of the invention can be switched between the latch position and swivel position to control whether the foot pedal to be swiveled against the stand of the musical instrument. By pushing the pushbutton the foot pedal can be folded, and by releasing the pushbutton the foot pedal can be latched without moving. The folding operation provided by the invention is simple and can be done quickly. Moreover, through the non-circular pin and second holding aperture formed in the shapes that form a latch structure, the force bearing area is greater and the structural strength is enhanced, thus can meet use requirements.

What is claimed is:

1. A foot pedal folding structure for a foot pedal swiveling against a stand of a musical instrument, comprising:

a swivel shaft including a circular pin, a first non-circular pin and a second non-circular pin, the circular pin being formed at a diameter no greater than the smallest diameter of the first non-circular pin and the second non-circular pin, wherein the circular pin is located between the first non-circular pin and the second non-circular pin;

a pedal rack for holding the foot pedal, the pedal rack including a first boss and a second boss, the first boss and the second boss respectively including a first holding aperture and a second holding aperture to allow the first and second non-circular pins to pass through and be latched therein without turning; and a rack sleeve for holding the stand, the rack sleeve including a rotary boss located between the first boss and the second boss, the rotary boss being formed at a thickness no greater than the length of the circular pin and including a rotary hole to allow the circular pin to swivel therein and latch the second non-circular pin from turning, the swivel shaft passing through the first holding aperture, the second holding aperture and the rotary hole in a slidable manner and including a latch position in which the second non-circular pin straddles the second holding aperture and the rotary hole and a swivel position in which the circular pin fully passes through the rotary hole.

2. The foot pedal folding structure of claim 1, wherein the diameter of the circular pin is equal to the smallest diameter of the non-circular pin.

3. The foot pedal folding structure of claim 1, wherein the pedal rack includes a base plate held on the foot pedal.

4. The foot pedal folding structure of claim 1, wherein the rack sleeve includes an orifice run through by the stand for holding the stand.

5. The foot pedal folding structure of claim 1, wherein the pedal rack and the rack sleeve respectively include an arched surface swiveling against each other and in contact with each other.

6. The foot pedal folding structure of claim 1 further including a pushbutton, a compression spring, a first fastening retaining plate and a second fastening retaining plate, the first and second fastening retaining plates being respectively fastened to two sides of the pedal rack, the first fastening retaining plate including an opening, the pushbutton being fastened to one end of the swivel shaft and running through the opening to be retained by the first fastening retaining plate, the compression spring being located between the second fastening retaining plate and the swivel shaft to push the swivel shaft to the latch position, the pushbutton being pressed to compress the compression spring to move the swivel shaft to the swivel position.

7. The foot pedal folding structure of claim 6, wherein the first fastening retaining plate and the second fastening retaining plate are respectively fastened to the pedal rack through at least one screw.

8. The foot pedal folding structure of claim 1, wherein the first non-circular pin and the first holding aperture are formed respectively in a square shape mating each other.

9. The foot pedal folding structure of claim 1, wherein the second non-circular pin and the rotary hole are formed in shapes mating each other, the second non-circular pin including a circular contact surface and at least one boss formed on the circular contact surface.

* * * * *